US006292962B1

(12) United States Patent
Dunn et al.

(10) Patent No.: US 6,292,962 B1
(45) Date of Patent: Sep. 25, 2001

(54) INFANT BLANKET WITH TEETHER/PACIFIER

(75) Inventors: Steven Dunn, Beverly Hills; Jennifer Fine, Chatsowrth, both of CA (US)

(73) Assignee: Munchkin, Inc., Van Nuys, CA (US)

( * ) Notice: Subject to any disclaimer, the term of this patent is extended or adjusted under 35 U.S.C. 154(b) by 0 days.

(21) Appl. No.: 09/471,728

(22) Filed: Dec. 23, 1999

Related U.S. Application Data

(63) Continuation of application No. 09/047,819, filed on Mar. 25, 1998, now abandoned.

(51) Int. Cl.[7] ..... A61J 17/00
(52) U.S. Cl. ..... 5/482; 5/655
(58) Field of Search ..... 5/482, 655; 606/234, 606/235, 236; 2/49.1; 215/11.1, 11.3, 11.4, 11.5, 11.6; 446/26, 27, 28

(56) References Cited

U.S. PATENT DOCUMENTS

| | | | |
|---|---|---|---|
| D. 62,152 | 3/1923 | Stokes . | |
| D. 84,810 | 8/1931 | Cowen . | |
| D. 136,167 | 8/1943 | Rubin . | |
| D. 145,896 | 11/1946 | Grosvenor | D34/2 |
| D. 147,852 | 11/1947 | Hyman | D34/4 |
| D. 166,051 | 2/1952 | Secter | D34/2 |
| D. 166,845 | 5/1952 | Bonafide | D34/2 |
| D. 264,630 | 5/1982 | Nakao et al. | D24/45 |
| D. 291,122 | 7/1987 | Grubb et al. | D24/45 |
| D. 295,654 | 5/1988 | Henn et al. | D21/187 |
| D. 298,958 | 12/1988 | Ulbrich | D21/166 |
| D. 304,237 | 10/1989 | Daykin | D24/45 |
| D. 331,786 | 12/1992 | Nadworny | D21/161 |
| D. 348,171 | 6/1994 | Keller | D6/598 |
| D. 349,345 | 8/1994 | Abrams | D24/195 |
| D. 349,346 | 8/1994 | Abrams | D24/195 |
| D. 351,471 | 10/1994 | Abrams | D24/195 |
| D. 374,468 | 10/1996 | Stevenson | D21/187 |
| 1,659,720 | 2/1928 | Cate . | |
| 2,408,735 | 10/1946 | Claflin | 128/359 |
| 2,827,055 | 3/1958 | Carden | 128/359 |
| 3,279,121 | 10/1966 | White | 46/163 |
| 3,392,729 | 7/1968 | Lenoir | 128/360 |
| 3,977,121 | 8/1976 | Goldfarb et al. | 46/151 |
| 4,277,910 | 7/1981 | Kramer | 46/116 |
| 4,694,510 * | 9/1987 | Kamrath | 2/49 |
| 4,697,589 | 10/1987 | King et al. | 128/359 |
| 4,884,991 | 12/1989 | Terzian | 446/369 |
| 4,994,075 | 2/1991 | Smith et al. | 606/235 |
| 5,147,384 * | 9/1992 | La Rocca | 606/234 |
| 5,288,257 | 2/1994 | Zacherl | 446/72 |
| 5,344,355 | 9/1994 | Silverstein | 446/72 |
| 5,385,573 | 1/1995 | Wright | 606/235 |
| 5,507,678 | 4/1996 | Chiang | 446/369 |
| 5,522,849 * | 6/1996 | Xiques et al. | 606/236 |
| 5,551,952 | 9/1996 | Falgout | 601/139 |
| 5,649,964 | 7/1997 | Berman et al. | 606/235 |
| 5,993,285 * | 11/1999 | Sofia | 446/327 |
| 6,041,950 * | 3/2000 | Soehnlein | 215/11.1 |

FOREIGN PATENT DOCUMENTS 985088 7/1951 (FR) .

* cited by examiner

*Primary Examiner*—Lynne H. Browne
*Assistant Examiner*—Fredrick Conley
(74) *Attorney, Agent, or Firm*—Knoble & Yoshida, LLC

(57) ABSTRACT

An infant blanket/towel is provided having one or more teething elements and/or pacifiers attached thereto. The invention is conveniently used by draping the blanket/towel across the infant's chest and stomach and initially providing one of the teething or pacifier elements into the infant's grasp. When and if the infant drops the teething or pacifier element, the element does not fall to the floor or otherwise out of the infant's reach. Because the blanket/towel generally remains draped across the infant, the pacifier or teething element merely slips down onto the infant's chest. By the infant's natural tendency to grip the blanket/towel and thrust the blanket/towel into its mouth, the infant frequently can relocate the pacifier or teething element and re-position it into its mouth.

10 Claims, 5 Drawing Sheets

INFANT BLANKET WITH TEETHER/PACIFIER

This is a continuation of application Ser. No. 09/047,819 now abandoned, filed on Mar. 25, 1998, the entirety of which is incorporated as if set forth fully herein.

BACKGROUND OF THE INVENTION

1. Field of the Invention

This invention relates generally to infant oral products and, more specifically, to infant teethers and pacifiers.

2. Description of the Related Technology

Infants universally enjoy sucking and chewing on various "oral elements." An artificial nipple, commonly termed a "pacifier," is a primary example. Another example is the large class of "teething" products designed to provide an infant relief from the pain and itching of cutting teeth.

Pacifiers and teething elements come in a wide variety of sizes and shapes. However, virtually all pacifiers and teething elements are manufactured and sold as small, individual items. The problem with this is that, when the infant drops the element, the infant is unable to locate and re-grasp the element. This is frustrating for the infant, and it is also frustrating to the infant's caregiver who must go to the infant, relocate the oral element, and re-position the oral element into the infant's hand or mouth.

Another problem with the small individual pacifiers and teething elements of the prior art is that whenever the infant drops the pacifier or teething element, it frequently falls onto the floor, ground or other unsanitary surface.

Attempts have been made to alleviate these problems by attaching the oral element to the infant via some form of tether. Although such tethers tend to prevent the oral element from falling onto an unsanitary surface, they do little to assist the infant in relocating and re-grabbing the device.

Accordingly, there is a need for a simple and inexpensive infant product having an oral element that avoids the above-described problems with the present state of the art.

SUMMARY OF THE INVENTION

The invention satisfies this need. The invention is a small blanket or towel having the oral element attached directly thereto.

In a typical embodiment, the blanket or towel is a soft woven material having a rectangular shape with an area of at least about 25 square inches. Affixed to one or more of the corners of the blanket/towel is a teething element and/or pacifier.

The invention is conveniently used by draping the blanket/towel across the infant's chest and stomach and by thereafter placing one of the oral elements into the infant's hand. If and when the infant drops the oral element, the infant can frequently relocate the oral element. One reason for this is that the oral element does not tumble off of the infant's body to some location beyond the infant's reach. The natural tendency of the blanket/towel to remain draped across the infant results in the oral element always remaining within the infant's reach. A second reason for the infant's ability to relocate the oral element is that all infants have a natural tendency to grasp and fondle a blanket/towel draped across him or her. When this occurs, the infant also has a natural tendency to thrust the blanket/towel into its mouth. With the instant invention, this frequently results in the infant being able to relocate the oral element and re-position that oral element into its mouth.

The invention thus provides a simple and inexpensive method to minimize tie frustrations felt by both infant and caregiver due to the infant's frequent dropping of its pacifier or teething element. The invention also minimizes the chances that the oral element will be dropped by the infant onto an unsanitary surface, such as on the ground or floor.

These and various other advantages and features of novelty that characterize the invention are pointed out with particularity in the claims annexed hereto and forming a part hereof. However, for a better understanding of the invention, its advantages, and the objects obtained by its use, reference should be made to the drawings which form a further part hereof, and to the accompanying descriptive matter, in which there is illustrated and described a preferred embodiment of the invention.

DETAILED DESCRIPTION OF THE PREFERRED EMBODIMENT(S)

Figure 1:
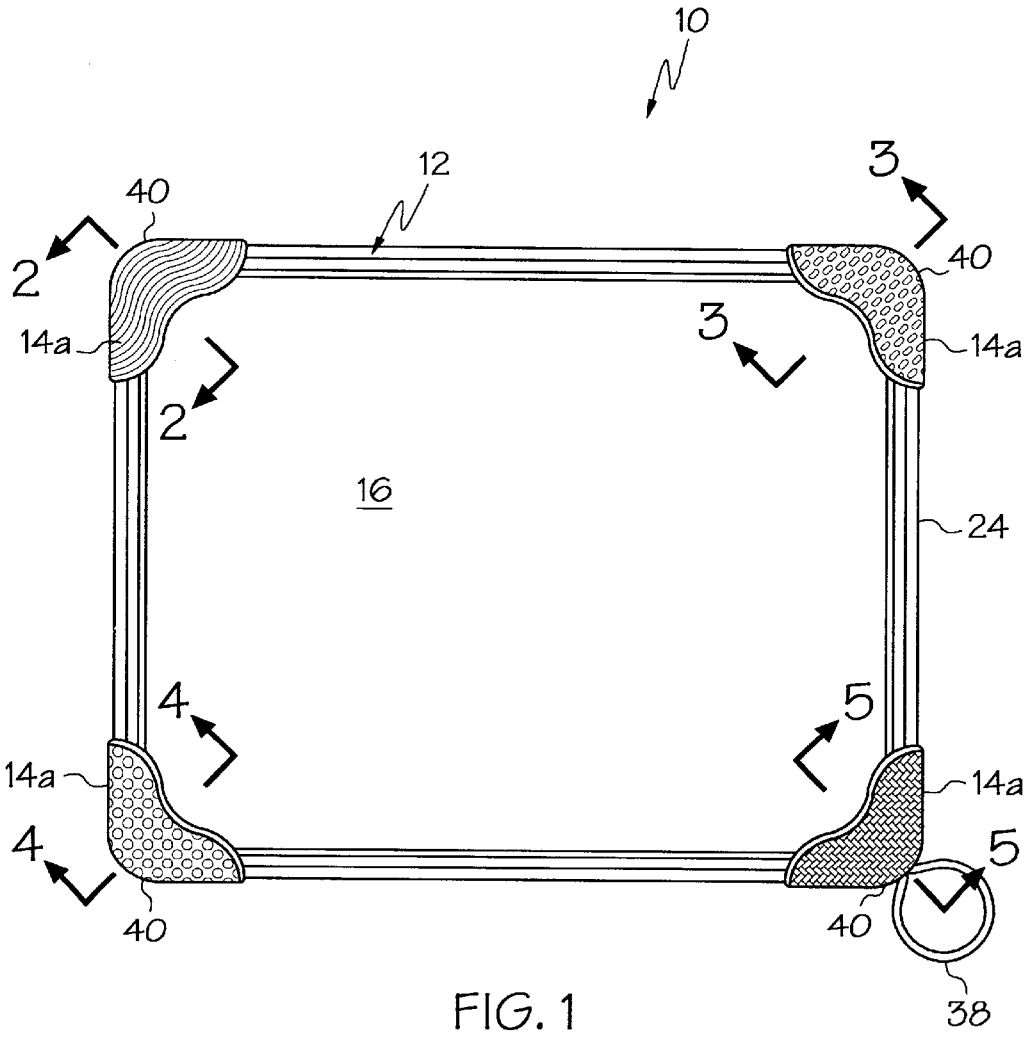
FIG. 1 is a plan view of an infant product having features of the invention.
Figure 2:
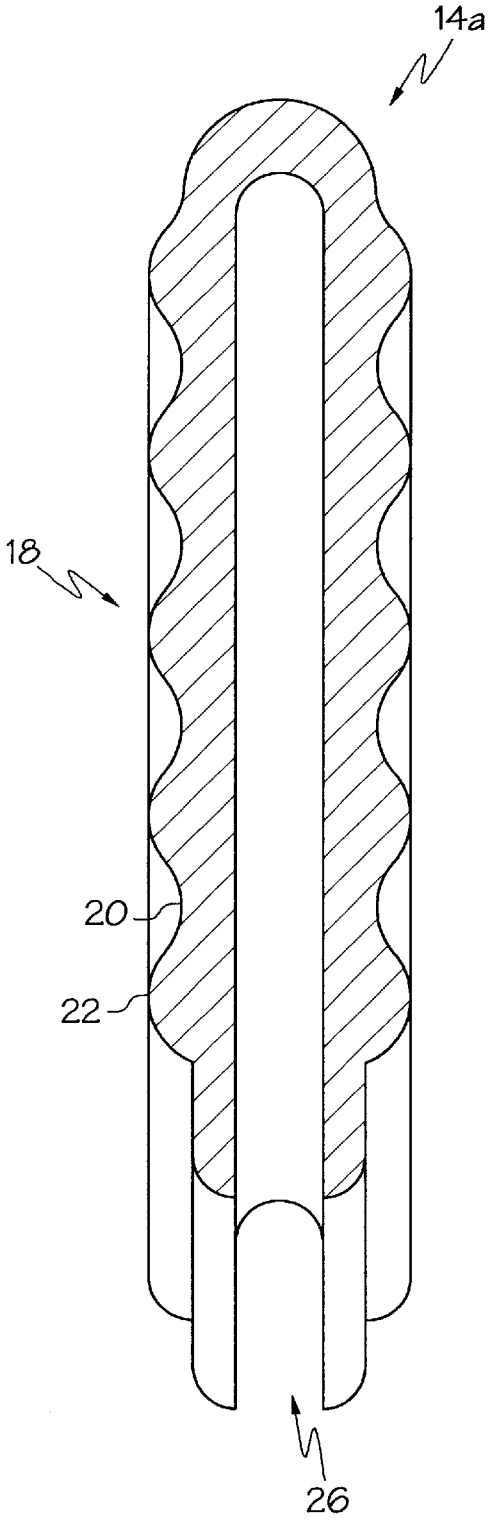
FIG. 2 is a cross-sectional side view of a first teething element illustrated in FIG. 1, taken along line 2—2.
Figure 3:
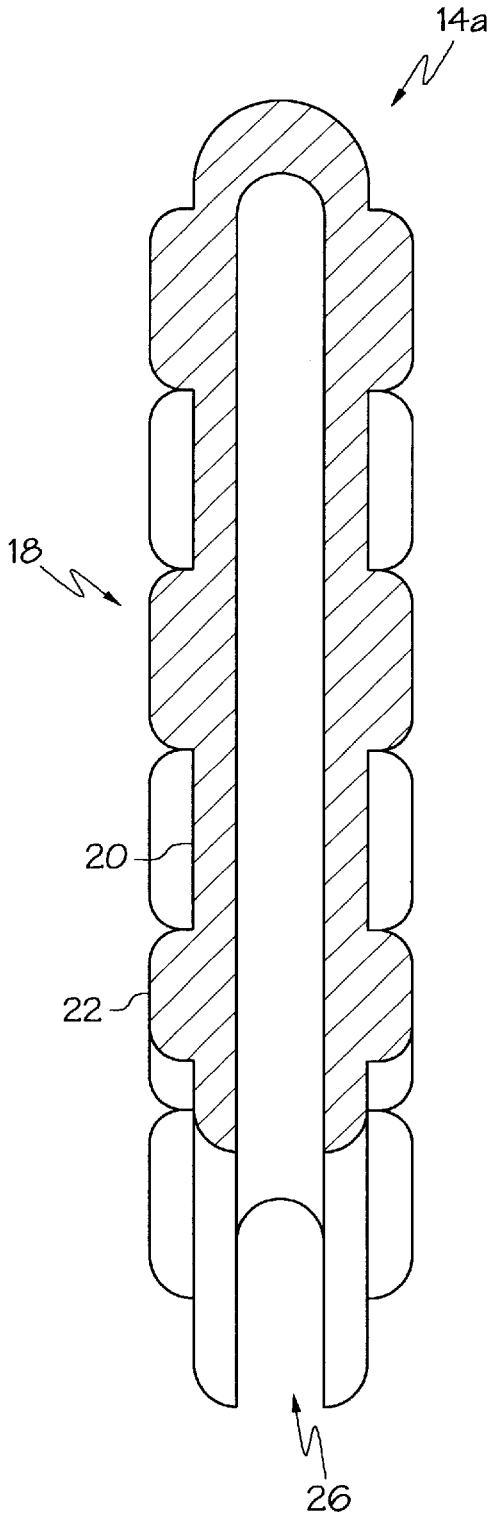
FIG. 3 is a cross-sectional side view of a second teething element illustrated in FIG. 1, taken along line 3—3.
Figure 4:
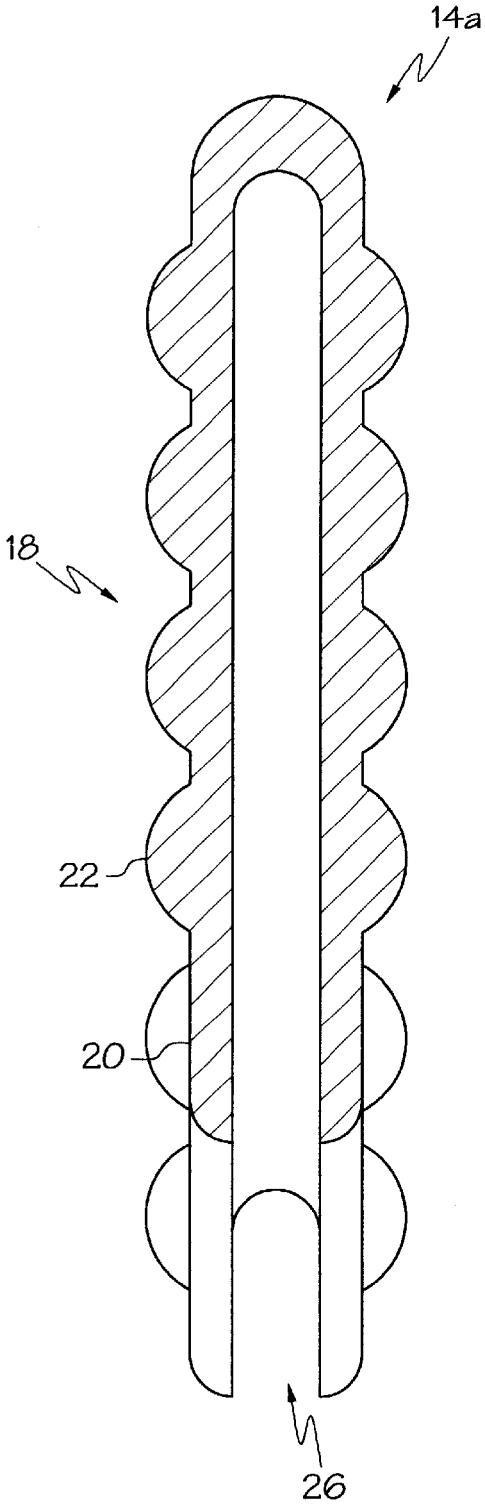
FIG. 4 is a cross-sectional side view of a third teething element illustrated in FIG. 1, taken along line 4—4.
Figure 5:
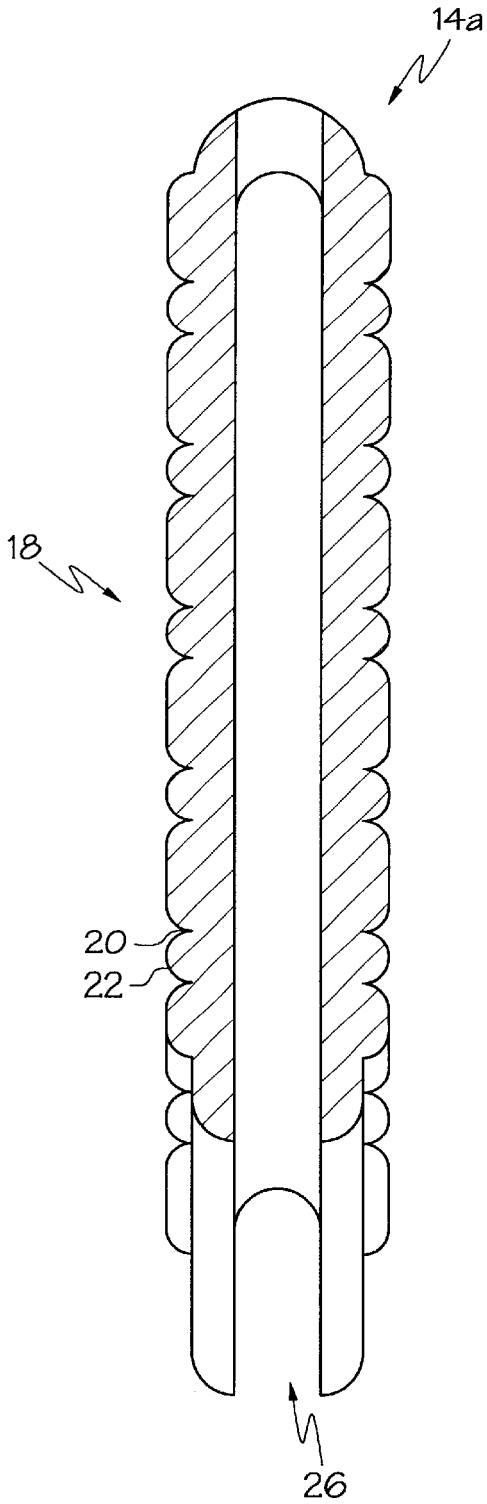
FIG. 5 is a cross-sectional side view of a fourth teething element illustrated in FIG. 1, taken along line 5—5.

Referring now to the drawings, wherein like reference numerals designate corresponding structure throughout the views, and referring in particular to FIG. 1, an infant product 10 that is constructed according to a preferred embodiment of the invention includes a substantially two-dimensional flexible material 12 with an oral element 14, such as a teething element 14*a* or a pacifier 14*b* attached thereto.

The term "substantially two-dimensional" is meant to be interpreted broadly to mean any flexible material having a relatively large front side 16, a matching back side and a thickness of less than about one inch, preferably less than about one half inch, and most preferably less than about One-quarter inch. The front side 16 and the back side of the flexible material is at least about 25 inches, preferably at least about 50 square inches, and most preferably at least about 100 square inches.

The flexible material 12 is typically a blanket or a soft towel. The flexible material 12 can also be a stuffed structure, such as a quilt or a thin pillow-like structure.

The flexible material 12 can be made from any material suitable for use with an infant, and can be woven or non-woven. In a typical embodiment, the flexible material 12 is a woven material having a woven weight value between about 140 pounds and about 300 pounds. When woven, the material can be made from cotton or other suitable organic or nonorganic material. In another embodiment, the flexible material 12 is made from ethylene vinyl acetate ("EVA") or other suitable non-woven material.

The oral element 14 can be any of the devices commonly known to give pleasure to an infant when inserted into the infant's mouth. In typical embodiments, the oral element 14 is a teething element 14*a* or a pacifier 14*b*. The term "teething element" is meant to be interpreted broadly to include all elements made from a non-toxic material, sized and dimensioned to be comfortably inserted and partially retained within an infant's mouth for teething purposes. Teething elements have no sharp edges capable of injuring the user, but have at least one non-smooth textured surface 18 comprising at least one minimum 20 and one maximum 22, the difference between such minimum 20 and maximum 22 being between about 0.5 mm and about 3 mm, preferably between about 1 mm and about 2 mm.

The oral element 14 is typically made from a suitable plastic or rubber material, but other materials may be used as well. The oral element 14 can be attached at the periphery 24 of the flexible material 12 or it can be attached inward from the periphery 24.

Where the oral element 14 is a teething element 14*a*, the oral element 14 can be conveniently attached at the periphery 24 of the flexible material 12. In a preferred embodiment, the teething element 14*a* has an internal slot 26 sized and dimensioned to accept an edge of the periphery 24 of the flexible material 12. The teething element 14*a* is attached to the flexible material 12 by placing a portion of the periphery 24 of the flexible material 12 into the internal slot 26 and then affixing the oral element 14*a* to the flexible material 12, such as by sewing, clamping or clipping. In the embodiments illustrated in FIGS. 1–5, the teething elements 14*a* are sewn to the flexible material.

Figure 6:
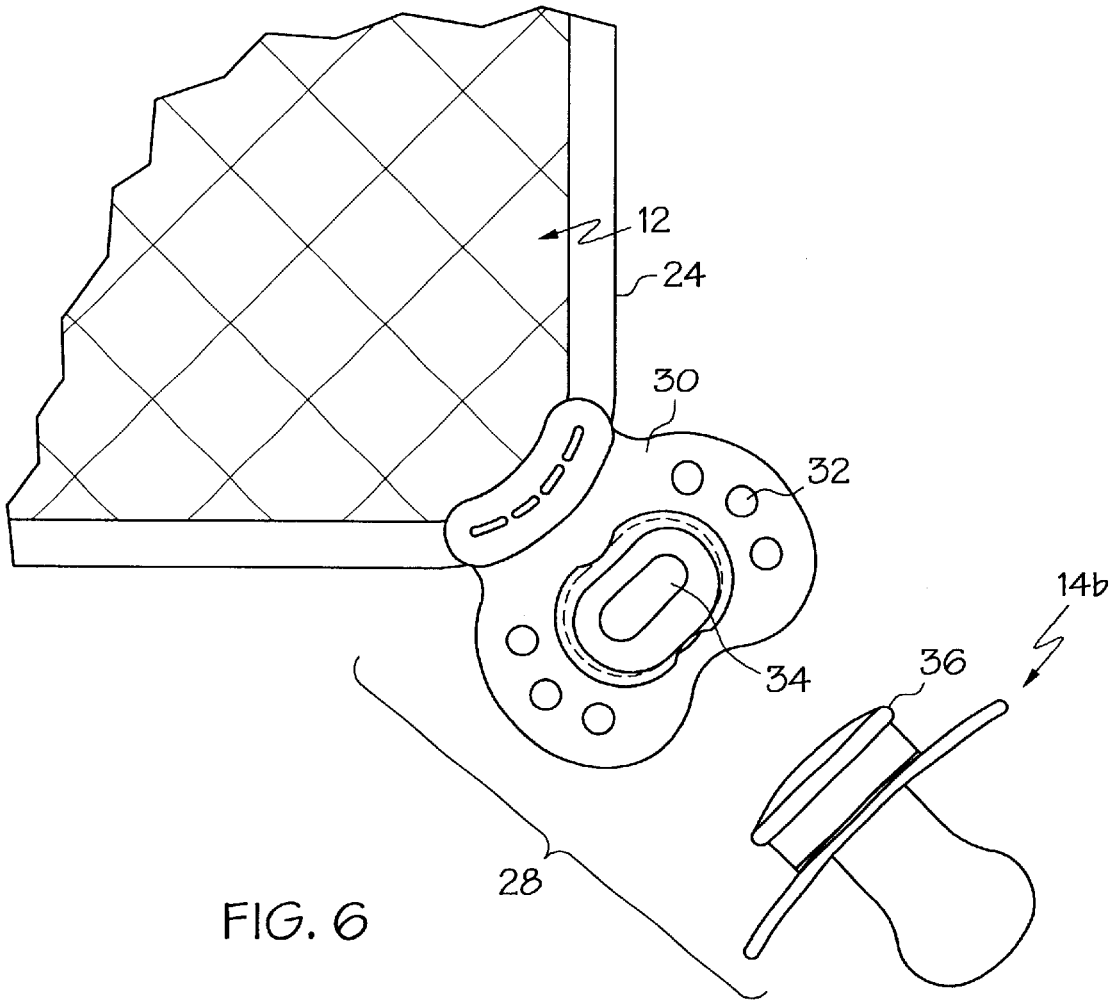
FIG. 6 is a detailed view of a pacifier snap-on connection useful in the invention.

In another embodiment, the oral element 14 is attached to the flexible material 12 by a mechanical closing element 28. Such mechanical closing element 28 can be a snap device such as shown in FIG. 6 or any other suitable mechanical closing element capable of retaining the oral element 14 to the flexible material 12. In the embodiment illustrated in FIG. 6, the snap device includes a snap plate 30 sewn to the flexible material 12 and a snap 36 attached to one end of a pacifier 14*b*. The snap plate 30 is made from a resilient material, such as a plastic or rubber. The snap plate 30 has air holes 32 and a snap retainer opening 34. The pacifier 14*b* having the snap 36 disposed at one end can be easily attached to the flexible material 12 and de-attached from the flexible material 12 (without the use of tools) by snapping the snap 36 into the snap retainer opening 34.

In yet another embodiment of the invention, the oral element 14 can be attached to the flexible material 12 by molding the oral element 14 to the flexible material. This can be accomplished in a wide variety of ways obvious to those skilled in the art. In all such ways, the oral element 14 is heat-formed onto the flexible material 12 or re-heated while in contact with the flexible material 12 such that the oral element material penetrates into the flexible material 12 while hot and then, after being cooled, rigidly adheres to the flexible material 12, where the oral element 14 is a pacifier 14*b*, the oral element 14 can also be attached to the flexible material 12 by a loop 38, such as illustrated in FIG. 1. Preferably, the loop 38 is made of a resilient material so that it will attach and firmly retain pacifiers 14*b* having a variety of shapes and dimensions.

In this and in other preferred embodiments, the pacifier 14*h* is easily de-attachable from the flexible material 12 and re-attachable to the flexible material 12 without the use of tools.

Figure 7:
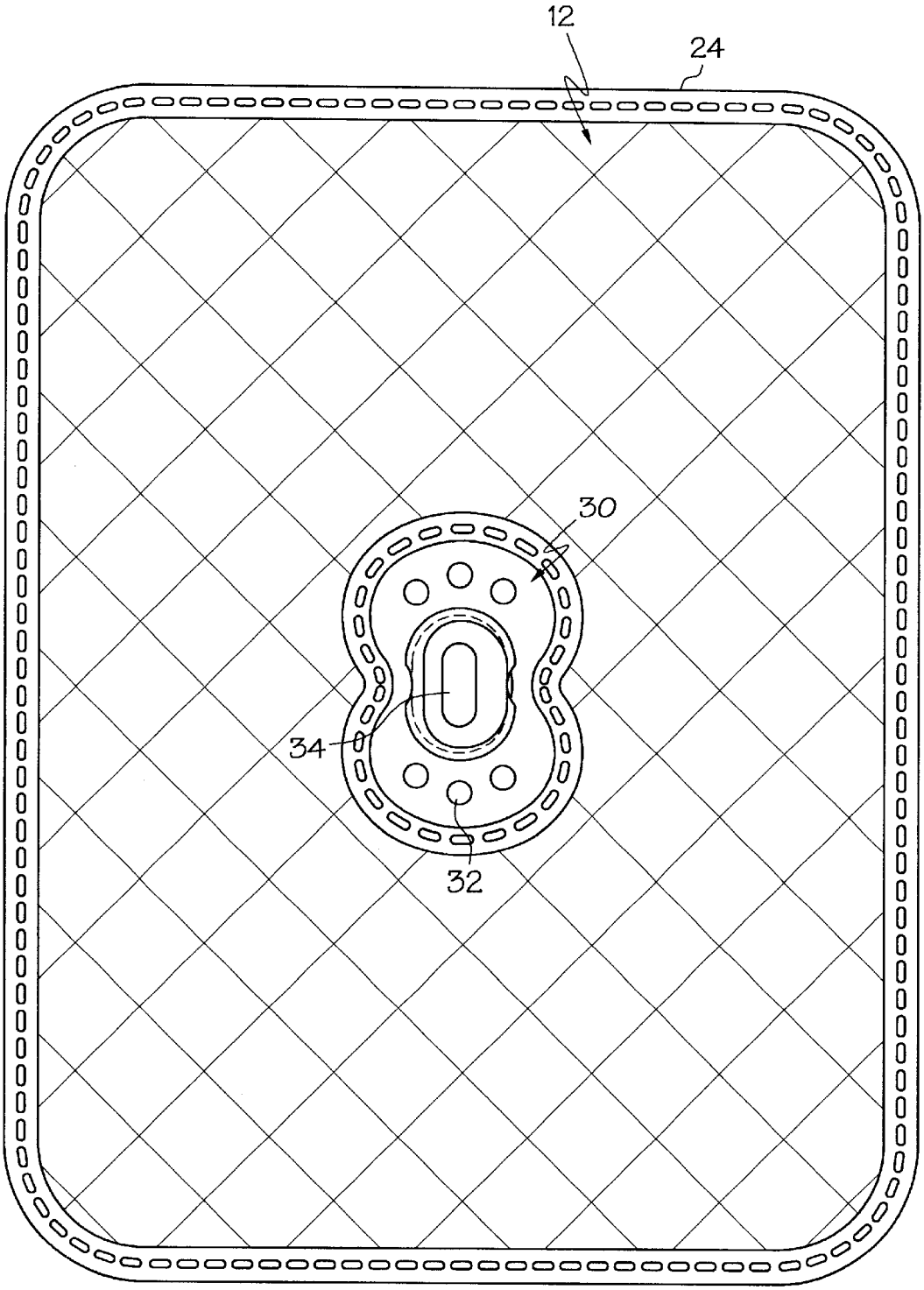
FIG. 7 is a plan view of a second infant product having features of the invention.

In other embodiments, the pacifier 14*b* can be attached directly to the surface of the flexible material 12. The pacifier 14*b* can be disposed proximate to the periphery 24 of the flexible material 12, or it can be disposed inward of the periphery 24. For example, FIG. 7 illustrates an embodiment having a snap plate 30 sewn into the center of the flexible material 12. Like the embodiment illustrated in FIG. 6, the snap plate 30 is adapted to accept and retain a pacifier 14*b* having a snap 36 into a snap retainer opening 34 in the snap plate 30.

As when the oral element 14 is a teething element 14*a*, when the oral element 14 is a pacifier 14*b*, the oral element 14 can be attached to the flexible material 12 by sewing, clamping, clipping, other suitable mechanical closing element 28 or by being molded directly to the flexible material 12.

A wide variety of product embodiments are possible from the invention. The drawings illustrate several typical embodiments wherein the flexible material 12 is rectangular, having four corners 40. In the embodiment illustrated in FIG. 1, the invention comprises four teething elements 14*a*, one disposed at each of the four corners 40 of the flexible material 12. In these embodiments each of the teething elements 14*a* has a different teething texture so as to give the infant user a large variety of teething surfaces to choose from.

In embodiments having a plurality of teething elements 14*a*, it is also preferable that different individual teething elements 14*a* are made from materials having different degrees of hardness. This provides the infant user with a choice of hardnesses.

The invention provides a simple and inexpensive new infant product having considerable advantages over the prior art. By use of the invention, the infant can be provided with a wide choice of oral elements in a single product. Moreover, the product is not easily dropped out of reach by the infant, but rather, is generally retained across the chest of the infant. This substantially increases the pleasure of the infant and minimizes frustration to both infant and caregiver. It also minimizes the health hazards due to repeated dropping of oral elements onto the floor, the ground, or other unsanitary surface.

It is to be understood, however, that even though numerous characteristics and advantages of the present invention have been set forth in the foregoing description, together with details of the structure and function of the invention, the disclosure is illustrative only, and changes may be made in detail, especially in matters of shape, size and arrangement of parts within the principles of the invention to the full extent indicated by the broad general meaning of the terms in which the appended claims are expressed.

What is claimed is:

1. An infant product, comprising:

a substantially two-dimensional flexible fabric material having a surface area that is greater than about 25 square inches, said flexible fabric material having a front side, a back side and a plurality of side edges that intersect so as to define at least two corners;

a first teething element that is permanently secured to a first of said at least corners, said first teething element being fabricated from a material selected from the group consisting of plastic and rubber, said first teething element having at least one non-smooth textured surface thereon and being fabricated from a non-toxic material and being sized and dimensioned to be comfortably inserted and partially retained within an infant's mouth for teething purposes; and a second teething element that is permanently secured to a second of said at least corners and that is separate from said first teething element, said second teething element also being fabricated from a material selected from the group consisting of plastic and rubber, said second teething element also having at least one non-smooth textured surface thereon and also being fabricated from a non-toxic material and being sized and dimensioned to be comfortably inserted and partially retained within an infant's mouth for teething purposes.

2. An infant product according to claim 1, wherein said non-smooth textured surface of said first teething element has a different texture than said non-smooth textured surface of said second teething element.

3. An infant product according to claim 1, wherein said first teething element is fabricated from a material having a first hardness, and said second teething element is fabricated from a material having a second hardness that is different from said first hardness.

4. An infant product according to claim 1, wherein said first and second teething elements are not pacifiers.

5. A method of teething, comprising steps of:

(a) grabbing a teething article that includes a flexible fabric material having a at least two corners, with at least first and second separate teether elements that are respectively secured to first and second of the corners, said first and second teething elements being fabricated from a material selected from the group consisting of plastic and rubber;

(b) alleviating the discomfort that comes with teething by biting on the first teething element; and (c) further alleviating the discomfort that comes with teething by biting on the second teething element.

6. A method according to claim 5, wherein said step of biting on the first teething element is performed with a first teething element that has a textured surface having a first pattern thereon, and wherein said step of biting on the second teething element is performed with a second teething element that has a second pattern thereon that is different from the first pattern.

7. A method according to claim 5, wherein said step of biting on the first teething element is performed with a first teething element that has a first hardness, and wherein said step of biting on the second teething element is performed with a second teething element that has a second hardness that is different from the first hardness.

8. A method of helping an infant to teethe, comprising steps of:

(a) providing to an infant a teething article that includes a flexible fabric material having at least two corners, with at least first and second separate teether elements secured to the respective corners, said first and second teething elements being fabricated from a material selected from the group consisting of plastic and rubber;

(b) permitting the infant to alleviate the discomfort that comes with teething by biting on the first teething element; and (c) permitting the infant to further alleviate the discomfort that comes with teething by biting on the second teething element.

9. A method according to claim 8, wherein said step of biting on the first teething element is performed with a first teething element that has a textured surface having a first pattern thereon, and wherein said step of biting on the second teething element is performed with a second teething element that has a second pattern thereon that is different from the first pattern.

10. A method according to claim 8, wherein said step of biting on the first teething element is performed with a first teething element that has a first hardness, and wherein said step of biting on the second teething element is performed with a second teething element that has a second hardness that is different from the first hardness.

* * * * *